US009462838B1

(12) United States Patent
Smith et al.

(10) Patent No.: US 9,462,838 B1
(45) Date of Patent: Oct. 11, 2016

(54) ADJUSTABLE APPAREL FIT TEMPLATE

(71) Applicant: Google Inc., Mountain View, CA (US)

(72) Inventors: Carl Ferman Smith, Mountain View, CA (US); Mitchell Joseph Heinrich, San Francisco, CA (US)

(73) Assignee: Google Inc., Mountain View, CA (US)

( * ) Notice: Subject to any disclaimer, the term of this patent is extended or adjusted under 35 U.S.C. 154(b) by 768 days.

(21) Appl. No.: 13/630,308

(22) Filed: Sep. 28, 2012

(51) Int. Cl.

| | |
|---|---|
| ***A41H 1/00*** | (2006.01) |
| ***A41H 1/02*** | (2006.01) |
| ***A41H 1/10*** | (2006.01) |
| ***A41H 3/00*** | (2006.01) |

(52) U.S. Cl.
CPC *A41H 1/00* (2013.01); *A41H 1/02* (2013.01); *A41H 1/10* (2013.01); *A41H 3/00* (2013.01)

(58) Field of Classification Search
CPC ..... A41H 1/00; A41H 1/02
See application file for complete search history.

(56) References Cited

U.S. PATENT DOCUMENTS

| | | | | |
|---|---|---|---|---|
| 2,158,456 | A | 5/1939 | Kaplan | |
| 6,341,504 | B1 | 1/2002 | Istook | |
| 6,381,482 | B1 | 4/2002 | Jayaraman et al. | |
| 6,415,199 | B1 * | 7/2002 | Liebermann | 700/132 |
| 6,564,118 | B1 | 5/2003 | Swab | |
| 7,301,435 | B2 * | 11/2007 | Lussey et al. | 338/13 |
| 7,365,031 | B2 * | 4/2008 | Swallow et al. | 442/181 |
| 7,992,217 | B2 | 8/2011 | Hyde et al. | |
| 8,034,001 | B2 | 10/2011 | Gal | |
| 2004/0199232 | A1 * | 10/2004 | Wallace et al. | 607/115 |
| 2009/0085444 | A1 * | 4/2009 | Alvarez Icaza Rivera et al. | 310/365 |

* cited by examiner

*Primary Examiner* — Alexander Satanovsky
*Assistant Examiner* — Ivan Rabovianski
(74) *Attorney, Agent, or Firm* — Lerner, David, Littenberg, Krumholz & Mentlik, LLP

(57) ABSTRACT

The present disclosure provide techniques for creating a template piece of clothing that can accurately determine a best "fit" of apparel on the consumer. The template may be made of a highly stretchable material with embedded sensors at various locations, wherein the sensors detect an amount of pressure exerted thereon. The template may also include embedded tensile members, such that when the template is worn by the consumer, the tensile members can constrict, expand, or otherwise adapt to the body measurements of the consumer. The template can thereby effectively measure the size and shape of the consumer wearing the template. The information regarding the size and shape of the consumer obtained by the template be outputted to a computer or other readout, and used by the consumer in determining whether corresponding apparel will fit properly.

18 Claims, 7 Drawing Sheets

700

ADJUSTABLE APPAREL FIT TEMPLATE

BACKGROUND

When purchasing garments online, specific consumer measurements are needed in order to ensure that the garments are a proper size and have a comfortable fit. However, mass customization of clothing using video scanning or input models is often inaccurate when used for creating garments, such as pants, shirts, etc. Particularly, where there are (1) measurements of depth, or thickness of hips, torso, etc., and (2) joint motions, or flex in the joints requiring flexion in the garment. In such cases, this tends to lead to many garments being returned by the consumers.

BRIEF SUMMARY

Aspects of this disclosure may be advantageous for accurately mass customizing garments for consumers. By using an adjustable template that can constrict, expand, or otherwise adapt to a consumer's body contours, the template can effectively measure the consumer's length, width and size in order to determine a best "fit" of garments on the consumer. In some aspects, the template can be automated to detect the consumer's body contours using pressure sensors to "sense" an appropriate fit of garments on the consumer based on a number of template presets, user inputs and/or sensor estimates of a best fit.

One aspect of the present technology provides a system that includes a template adapted to be worn by a user. The template may comprise a plurality of sensors configured to obtain body measurement information of the user. The system also includes a computing device in communication with the plurality of sensors. The computing device may be configured to determine a set of dimensions of at least one portion of the user based on the body measurement information. In that regard, the set of dimensions may correspond to a length, width, depth and size of the one portion of the user.

In one example, the template may further comprise an elastic material that can adjust to body contours of the user. In another example, the sensors are arranged to detect an amount of tension exerted in a given area of the template. In this example, the computing device is further configured to map a number of coordinates to the given area of the template based on the amount of tension exerted in the given area. An outline of the user may be generated by the computing device based on the mapping coordinates. The outline may correspond to the body measurements of the user.

Another aspect of the present technology provides a system that includes a template adapted to be worn by a user and a computing device in communication with the template. The template may comprise a plurality of tensile members configured to obtain body measurement information of the user. The computing device may be configured to determine a set of dimensions of at least one portion of the user based on the body measurement information. In that regard, the set of dimensions may correspond to a length, width, depth and size of the one portion of the user.

In one example, the tensile members can be adjusted in a longitude and lateral direction. In this example, an input device may be coupled to the template and configured to receive size measurements for the template. The tensile members may be adjusted in response to the inputted size measurements, so as to conform the template to body contours of the user. In another example, the computing device may be further configured to map a number of coordinates to a given area of the template based on the longitude and lateral positions of the tensile members. Cross sectional measurements of the template may be calculated by the computing device based on the mapping coordinates. The cross sectional measurements may correspond to the body measurements of the user.

Yet another aspect of the present technology provides a system that includes a template adapted to be worn by a user, a client device coupled to the template and a server in communication with the client device. The template may include a sensing layer configured to obtain body measurement information of the user. The client device may be configured to receive the body measurement information from the template and to determine size measurements for the template. The server may be configured to receive the size measurements from the client device and to calculate a custom fit of a garment for the user based on the size measurements.

DETAILED DESCRIPTION

Aspects, features and advantages of this disclosure will be appreciated when considered with reference to the following description of embodiments and accompanying figures. It should be noted that the same reference numbers in different drawings may identify the same or similar elements. Furthermore, the following description is not limiting; the scope of the present technology is defined by the appended claims and equivalents.

The present disclosure generally relates to creating a template piece of clothing that is roughly the shape of a consumer to be used to accurately determine a best "fit" of apparel on the consumer. According to aspects, this template may include embedded tensile members, such that when the template is worn by the consumer, the tensile members can constrict, expand, or otherwise adapt to the body measurements of the consumer. In one aspect, the template may be made of a highly stretchable material with embedded sensors at various locations, wherein the sensors detect an amount of pressure exerted thereon. The tensile members or sensors thereby effectively measure a length, width and size of the consumer. In this regard, the size of the consumer may include the consumer's body depth, soft contours, and comfortable (non-pressured) motion ranges that are difficult for computer vision or other methods of measurement to quantify. The information regarding the body measurements of the consumer obtained by the template may be output to a computer or other readout, and used by the consumer in determining whether other garments will fit properly. In some aspects, consumers may also provide manual input to the template or computer to identify fit preferences, such as a more snug fit in some areas and a looser fit in other areas.

Figure 1:
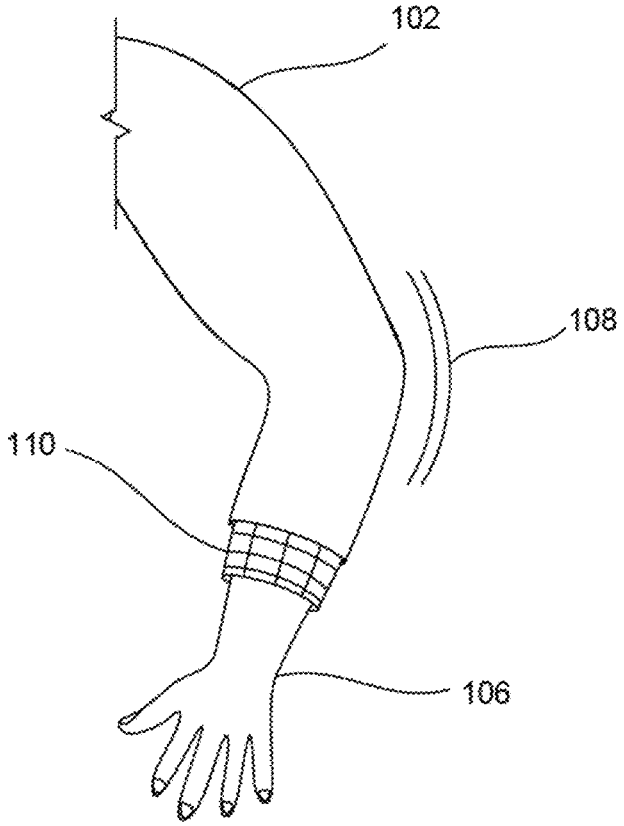
FIG. 1 is an example of an adjustable template in accordance with aspects of the disclosure.

FIG. 1 is an example of an adjustable template 102. According to aspects, the template 102 can be constructed from a wide range of materials, such as fabric, nylon, latex, a flexible polymer or any type of material that can be fashioned into a wearable item. For example, the material can be a regular two-dimensional type of fabric like a blend of cotton and polyester. The template 102 can also be constructed from a material composed of a single type of fabric (e.g., 100% wool or cotton). In some aspects, a full template can be fashioned into a rough shape of garment that can be worn by a user 106, such as an oversized piece of clothing that can be adjusted down to the user's measurements. For example, the full template can be in the shape of a shirt, a pair of pants, a full body suit or any configuration of garments that can be worn. As shown in FIG. 1 merely as an illustrative example, a view of a sleeve of a full template is provided. The template 102 may be a size slightly larger than the actual size of the user 106. This may allow the template 102 to be adjusted down to the contours of the user wearing the template 102.

Integrated into the template 102 may be a sensing layer 110 that can, for example, sense tension applied to the template 102. As shown in FIG. 1, if the user 106 bends his/her arm, the tension indicated by the elliptical lines 108 may tend to pull on the template 102 with the integrated sensing layer 110 against the body of the user 106. As later discussed, the tension created between the template 102 and the user 106 can be used to calculate body measurements of the user 106.

The sensing layer 110 can be woven into the template 102 when the template 102 is constructed. For example, the sensing layer 110 can be made of a flexible fiber material that can be integrated into the template 102. Alternatively, the sensing layer 110 can be attached to the inner layer of the template that is in closest contact with the user 106. For example, the sensing layer 110 can be attached to an inside layer of the template 102 using a number of techniques, such as an adhesive, sewing, zippers, buttons, etc. By modularizing the design of the template 102 and the sensing layer 110, the sensing layer 110 can be made independent of the template 102 for ease of replacement, alternate configurations, maintenance and storage.

Figure 2:
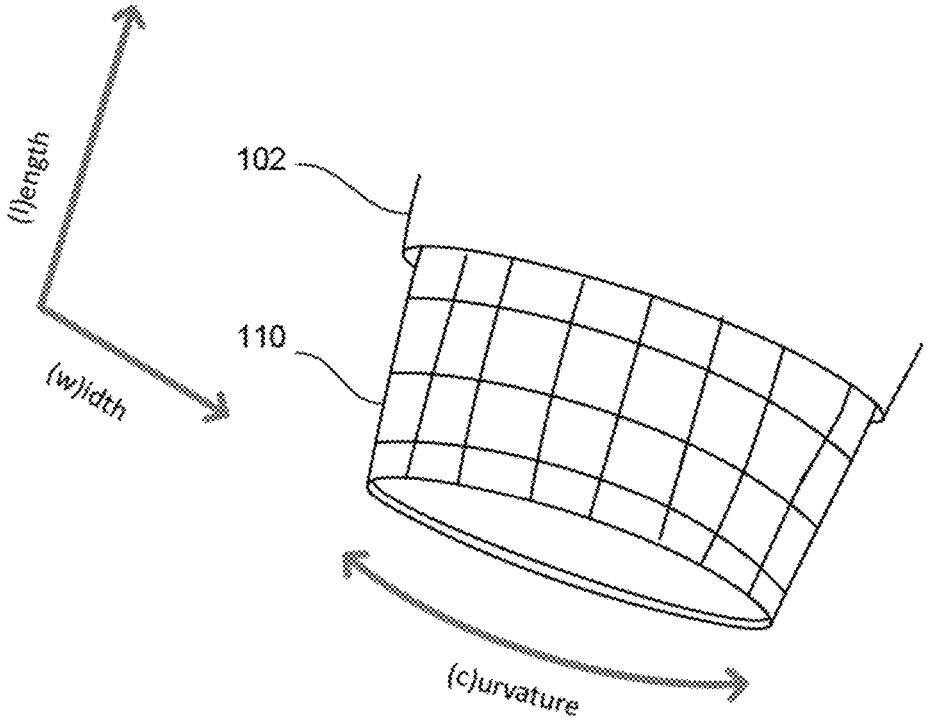
FIG. 2 is a section of the template of FIG. 1 in accordance with aspects of the disclosure.

With reference to FIG. 2, a section of the template 102 of FIG. 1 is shown. This section of template 102 is depicted with the integrated sensing layer 110 that may be used, for example, to determine body measurements of a user wearing the template 102. The sensing layer 110 may be integrated throughout the template 102, which may be constructed in a rough shape of a garment. As discussed, the sensing layer 110 can be woven into the template 102 or attached like an inner liner. Because the sensing lay 110 is integrated throughout the template 102, it can come into contact with various parts of the user's body that are covered by the template 102. An advantage of this type of configuration is that the template 102 may be able to detect measurements (e.g., size, body depth, soft contours, etc.) of the user at different areas of the user's body. For example, the template 102 may be adapted to take a series of measurements around the user's body much like a tailor using a number of flexible tape measures all at once. As depicted in FIG. 2, in addition to detecting length and width measurements, the template 102 may be able to simultaneously detect size and/or curvature measurements of the user at various areas. This may allow the template 102 to detect measurements of areas of the user's body that are needed in order to determine a comfortable fit for clothing, such as a user's crotch area, waist, hips, chest, and under the user's armpits. The sensing layer 110 may also sense shape changes in cross sections and areas of the user's body through a range of motions where a static system (e.g., camera based) may not be capable of doing with nearly the same level of accuracy. This may be useful in creating garments, such as compression garments for athletes, which are not only optimized and fitted for the user's body while standing, but also sitting, walking and running.

There are several ways that the template 102 can be configured to detect body measurements of a user wearing the template 102. As one example, the template 102 may include a plurality of tensile members that can be adjusted to the body measurements of the user. As a second example, the template 102 may be embedded with sensors at various locations, wherein the sensors can detect an amount of tension exerted in certain areas or the lack thereof. These examples are further described below with respect to FIGS. 3-4.

Figure 3:
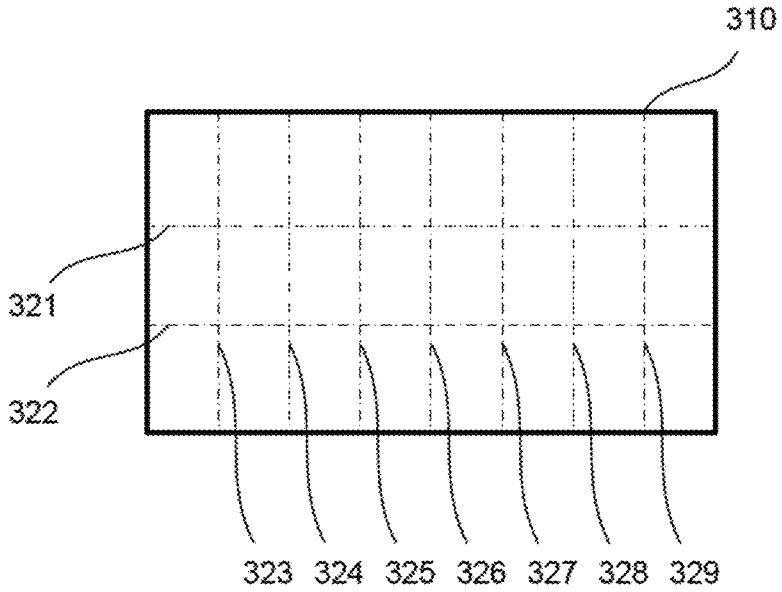
FIG. 3 is an example of a partial view of a template with tensile members in accordance with aspects of the disclosure.

FIG. 3 is an example of a partial view of a template 310 with tensile members 321-329, which describes the first example of a way to configure a template for determining body measurements of a user wearing the template 310. According to one aspect, the tensile members can be constructed of a flexible material, such as a metal fiber or wire coil. In this regard, when attached to the template 310, the tensile members 321-329 are capable of cinching (e.g., tightening) up to apply tension on the template 310 to bring it closer to the user and thereby holding it next to the user's body. For example, tensile members 321 and 322, when adjusted, may contract or expand the template 310 in a longitudinal direction, while tensile member 323-324 may adjust the template 310 in a latitudinal direction. The tensile members 323-329 can be cinched or loosened until the template 310 achieves a desired tension between the template 310 and the body of the user.

A variety of technologies may be employed to adjust the tensile members 321-329 to a desired tension against the user. For example, the tensile members 321-329 can be mechanically coiled or spooled using, for example, a lever, crank, winch or some other type of mechanical device that is used to pull in (e.g., wind up) or let out (e.g., wind out) or otherwise adjust tension. In one scenario, a flexible air bladder connected to a pump assembly may be attached to the template 310. The air bladder may be in contact with the tensile members 312-329 and may be placed between those members and the template 310. The pump assembly can be used to inflate the air bladder until a desired tension is achieved between the template 310 and the user's body. For example, the pump assembly can be a motorized pump, a bulb that the user squeezes to inflate the air bladder or any other means of allowing air flow in and out of the air bladder. In one aspect, the tensile members may be adjusted by using, for example, an input device. For example, the user may be able to input size preferences, which may in turn tighten or loosen the tensile members 321-329 as needed. In some situations, a sensing platform may be employed to automatically adjust the tensile members in areas where the sensing platform has detected slack in the template or too much tension against the user's skin.

Once the desired tension between the user and the template 310 has been achieved, the user body measurements can be determined. Tension within an intermediate region of the template 310 can be measured based on the longitudinal and latitudinal displacement of the tensile members 321-329. For example, as the tensile members 321-322 expand and/or contract a length of the displacement can be compared to the original length of the tensile members. Hence, yielding a result which will accurately estimate the length of the tensile member that is around the user. In other situations, the estimated length of the tensile members may be combined with sensor pressure data from the sensing platform described above to determine an appropriate distance of the template from the user's skin for a "best fit."

In some aspects, cross sectional measurements of the template 310 can be mapped to (x,y,z) coordinates associated with each tensile member. For example as shown in FIG. 3, as tensile member 322 crosses the other tensile members 323-329 positioned along a length of the template 310, each intersection can be interpolated into an a (x,y,z) coordinate. The x and y axis of the coordinates may map to a location on the template 310 that is resting against the contours of the user wearing the template 310. While the z axis may represent a distance from the template to a surface of the user, which may be determined based on a detected amount of pressure in an area of the template 310. It should be appreciated that a large number of (x,y,z) coordinates can be determined in this manner based on the size of the template 310 employed and the number of tensile members integrated into the template 310. For example, to increase the accuracy of the template 310 in measuring the body of the user, the tensile members 321-329 can be placed closer together at a predetermined distance. The distance between each mapping coordinate can be measured using various known scales, such as inches, millimeters, centimeters, etc. As a result, the mapping coordinates for the template 310 can be used to generate an accurate outline of clothing that may be a best "fit" on the user.

Figure 4:
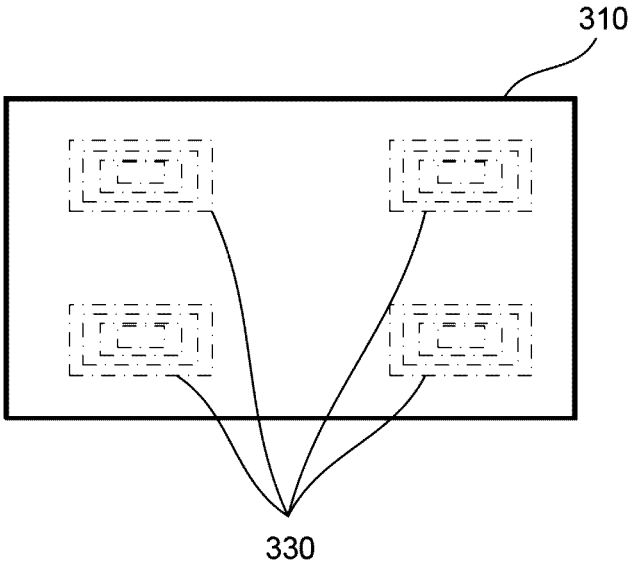
FIG. 4 is an example of a partial view of a template with sensors in accordance with aspects of the disclosure.

FIG. 4 is an example of a partial view of a template 310 with sensors 321, which describes a second example for configuring a template to determine the user's body measurements. In this example, the template 310 may be composed of a material, such as latex or spandex, which can expand, contract or otherwise stretch to conform the contours of a user wearing the template 310. As shown, embedded or attached to the template 310 may be one or more sensors 330. For example, the sensors 330 can be woven in the template 310 when it is constructed or they can be later attached using a type of adhesive.

The sensors 330 may be configured to detect areas of excess pressure applied to an area of the template 330. The excess pressure may be in response to the template 330 adjusting to the contours of the user. Similar to the tensile members described in FIG. 3, the sensors 330 can be placed at a predetermined distance from each other. Each sensor's field of sensitivity may have a small degree of overlap with another sensor. An advantage of this type of configuration is so that cross readings from the sensors 330 can be mapped to any given (x,y,z) coordinate associated with a position on the template 310 when taking into account a given distance of the template 330 from the user's body or from other points on the template 310. For example, this may include a distance from a given front or back (x,y) position or an estimated distance of the template 310 from the user's skin (e.g., z-axis). As discussed, by mapping out coordinates for multiple positions along the template 310, the mapping may be use to generate an accurate outline of clothing that may be a best "fit" on the user.

The sensors 330 can be constructed using, for example, various types of Near Field Communication (NFC) technologies. According to aspects, use of a NFC type sensor provides a low cost wireless platform that can be completely passive (e.g., no external power supply required) in transferring sensor data for later processing. It should be appreciated that this is merely one example of how data can be transferred from the template 310 to a client device. For example, other types of wireless communication protocols can be used to transfer the mapping data, such as WiFi, Bluetooth, short-wave radio or a number of wireless technologies used to transfer data over a short distance. In one aspect, the template may be enabled to store the mapping data on a type of non-transitory computer readable medium capable of storing information such as a USB drive, memory card, CD-ROM or one of several types of storage mediums that can be later transferred to a client device for processing.

Figure 5:
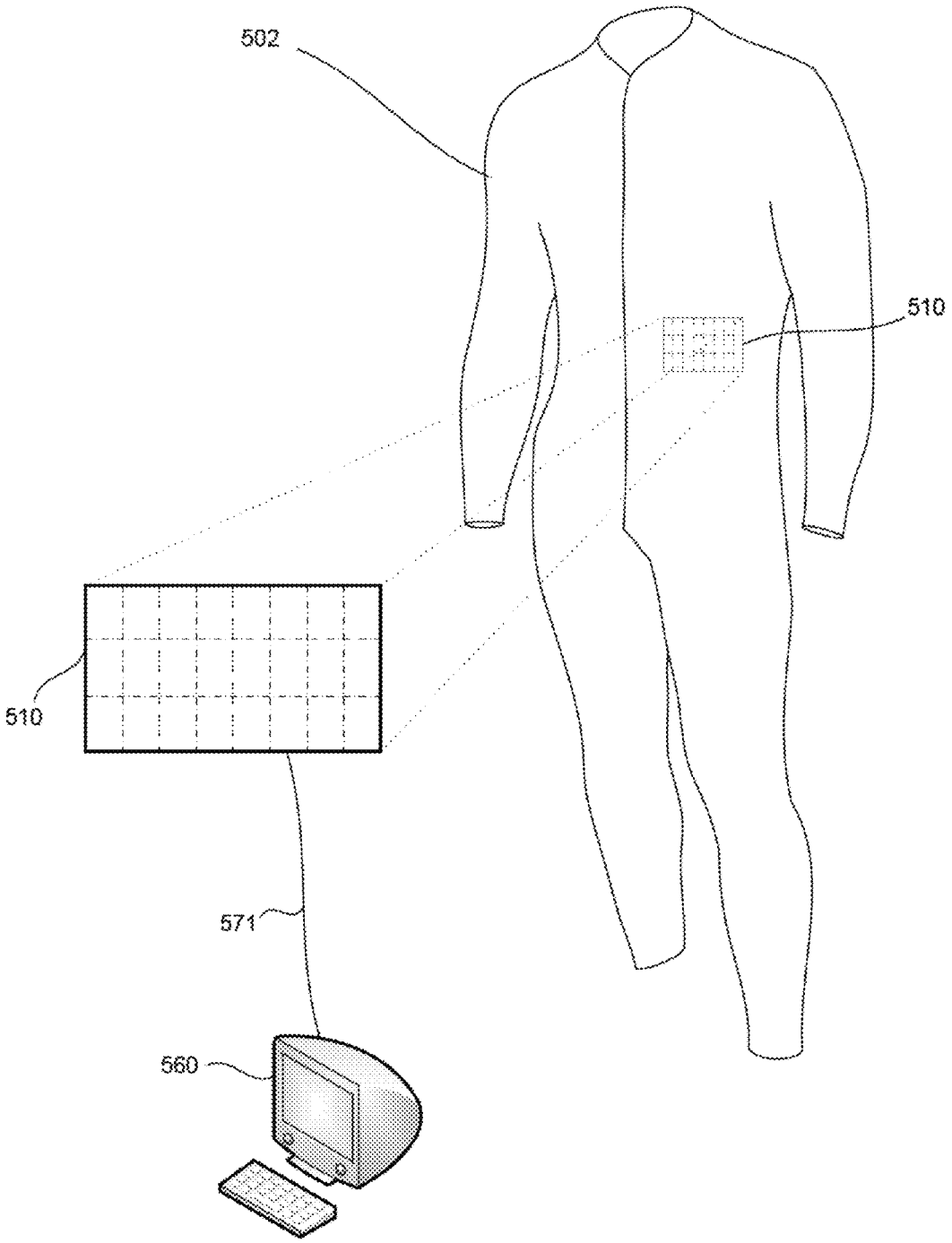
FIG. 5 is an illustration of an adjustable template in communication with an example client device in accordance with aspects of the disclosure.

FIG. 5 is an illustration of an adjustable template 510 in communication with an example client device 560. As shown, the template 510 may be integrated throughout a garment 502 that can be worn by a user. According to one aspect, the template 510 can be coupled to a client device 560 via a connection 571. For example, the connection 571 can be a wired or wireless connection. In this regard, the template 510 may include necessary networking components to facilitate communication with the client device 560. By way of example only, the client device 560 may be a portable personal computer, such as a wireless-enabled PDA, a tablet PC, or a netbook capable of obtaining information from the template 510 via the connection 571. Alternatively, client device 560 may also include a mobile device such as a mobile phone intended for use by the user.

The client device 560 may be configured to send and receive size information from the template 510. For example, a user may input preferred size measurements for the template 510 using a keyboard connect to the client device 560. In this regard, the template may adjust in response to the inputted size measurements. The device may show these preferences on a display for the user to confirm before sending the measurements to the template 510 for adjustments. The client device 560 may also receive measurement information (e.g., a set of dimensions describing the user's length, width and size) sent from the template 510. For example, the measurement information may be determined based on detected contours of a user wearing the garment 502.

Figure 6:
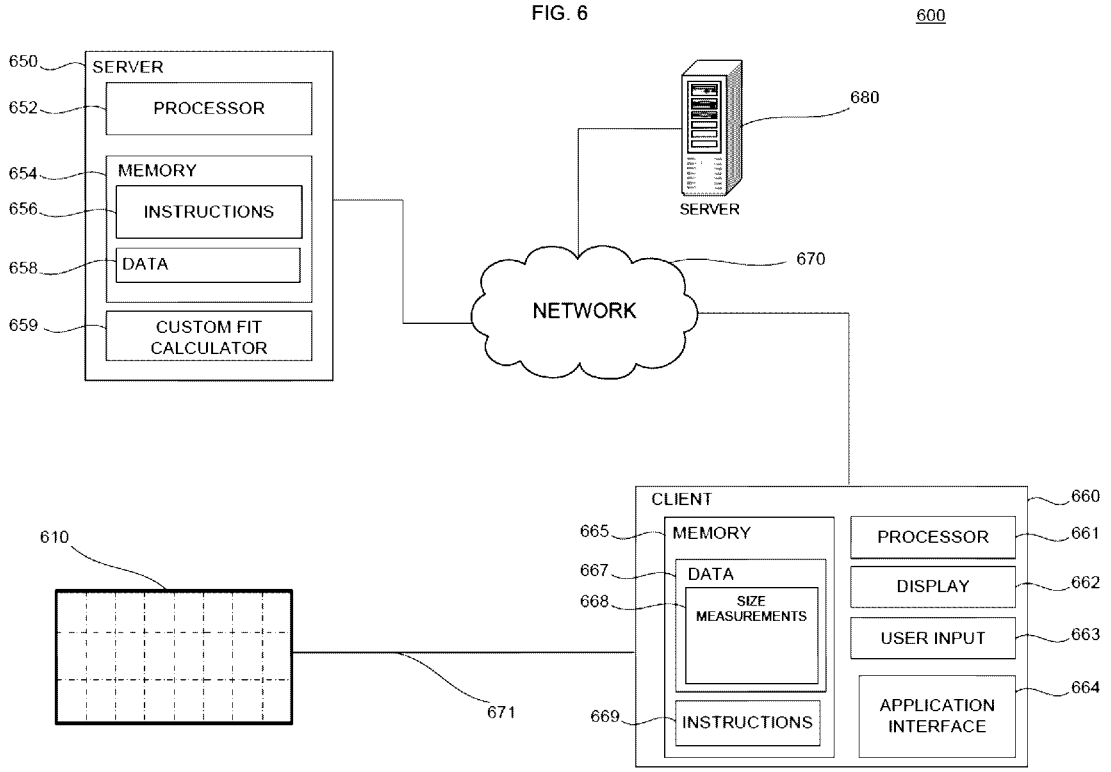
FIG. 6 is a diagram of a system in accordance with aspects of the disclosure.

FIG. 6 is a diagram of a system 600, which includes a template 610 for determining the custom "fit" measurements of a user wearing the template 610. As shown, the system 600 may include a client 660 in communication with the template 610 via a connection 671. The system 600 may also include a number of servers 650 and 680 capable of wireless communication with the client 660 over a network 670.

The client 660 may contain a processor 661, memory 665, instructions 669, and data 667. Each client 660 may be a personal computer, intended for use by a person having all the internal components normally found in a personal computer such as a central processing unit (CPU), CD-ROM, hard drive, and a display device 662, for example, a monitor having a screen, a projector, a touch-screen, a small LCD screen, a television, or another device such as an electrical device that can be operable to display information processed by the processor 661, speakers, a modem and/or network interface device, user input device 663, such as a mouse, keyboard, touch screen or microphone, and all of the components used for connecting these elements to one another. Moreover, computers in accordance with the system 600 described herein may include devices capable of processing instructions and transmitting data to and from humans and other computers including general purpose computers, PDAs, network computers lacking local storage capability, set top boxes for televisions, and other networked devices.

The client 660 may include an application interface module 664. The application interface module may be used to access a service made available by a server, such as servers 650 and 680. For example, the application interface module may include sub-routines, data structures, object classes and other type of software components used to allow servers and clients to communicate with each other. In one aspect, the application interface module 664 may be a software module operable in conjunction with several types of operating systems known in the arts. For example, the client 660 may be connected to a Structured Query Language (SQL) database server that may operate in conjunction with the application interface module 664 for saving and retrieving measurement information data. Memory 665 coupled to a client 660 may store this data that can be accessed by the application module 664.

The data 667 can be retrieved, stored or modified by the processor 661 in accordance with the instructions 669. For instance, although the system 600 is not limited by a particular data structure, the data 667 can be stored in computer registers, in a relational database as a table having a plurality of different fields and records, or XML documents. The data 668 can also be formatted in a computer-readable format such as, but not limited to, binary values, ASCII or Unicode. Moreover, the data 667 can include information sufficient to identify relevant information, such as numbers, descriptive text, proprietary codes, pointers, references to data stored in other memories, including other network locations, or information that is used by a function to calculate relevant data. For example, the data 667 can include size measurements 668 that may be encoded based on the instructions 669 in a unit of measurement used to describe measurements of garments, such as inches, millimeters and centimeters. In some aspects, the size measurements can be received from the template 610 via the connection 671 or inputted by a user through the user input device 663.

Each server 650 and 680 may be configured, similarly to client 660, with a processor 652, memory 654, instructions 656, and data 658. The memory 654 can store information accessible by the processor 652, including instructions 656 that can be executed by the processor 652. The memory 654 can also include data 658 that can be retrieved, manipulated or stored by the processor 652. The memory 654 may be a type of non-transitory computer readable medium capable of storing information accessible by the processor 652, such as a hard-drive, memory card, ROM, RAM, DVD, CD-ROM, write-capable, and read-only memories. The processor 652 can be a CPU. Alternatively, the processor 652 can be a dedicated controller such as an ASIC.

The instructions 656 can be a set of instructions executed directly, such as machine code, or indirectly, such as scripts, by the processor 652. In this regard, the terms "instructions," "steps" and "programs" can be used interchangeably herein. The instructions 656 can be stored in object code format for direct processing by the processor 652, or other types of computer language including scripts or collections of independent source code modules that are interpreted on demand or compiled in advance. Functions, methods and routines of the instructions are explained in more detail below.

The data 658 can be retrieved, stored or modified by the processor 652 in accordance with the instructions 656. For instance, although the system 600 is not limited by a particular data structure, the data 658 can be stored in computer registers, in a relational database as a table having a plurality of different fields and records, or XML documents. The data 658 can also be formatted in a computer-readable format such as, but not limited to, binary values, ASCII or Unicode. Moreover, the data 658 can include information sufficient to identify relevant information, such as numbers, descriptive text, proprietary codes, pointers, references to data stored in other memories, including other network locations, or information that is used by a function to calculate relevant data.

Although FIG. 6 functionally illustrates the processor 652 and memory 654 as being within the same block, the processor 652 and memory 654 may actually include multiple processors and memories that may or may not be stored within the same physical housing. For example, some of the instructions 656 and data 658 can be stored on a removable CD-ROM and others within a read-only computer chip. Some or all of the instructions and data can be stored in a location physically remote from, yet still accessible by, the processor 652. Similarly, the processor 652 can actually include a collection of processors, which may or may not operate in parallel.

As shown in FIG. 6, server 650 may also include a custom fit calculator 659. The custom fit calculator 659 may be operable in conjunction with the client device 660 from which it may receive size measurement data used in determining a custom fit for a garment. According to aspects, the size measurement data 668 may be determined by the template 610, which is adapted to detect contours of a user wearing the template 610. The custom fit calculator 659 may use this data to map out (x,y,z) coordinates associated with a given position on the template 610. For example, the coordinates may represent cross sectional measurements made throughout the template 610 in response to the template 610 adjusting to the contours of the user. In that regard, the distance between each mapping coordinate can be measured using various known scales, such as inches, millimeters, centimeters, etc. As a result of mapping out coordinates for various positions on the template 310, an accurate outline of clothing that may be a best "fit" on the user can be generated. Although the custom fit calculator 659 is shown on server 650, it could also be located in a client, server machine or any combination thereof.

Servers 650 and 680 may be at one node of network 670 and capable of directly and indirectly communicating with other nodes of the network 670. For example, the servers 650 and 680 can include a web server that may be capable of communicating with client device 660 via network 670 such that it uses the network 670 to transmit information to a client application. Servers 650 and 680 may also include a number of computers, e.g., a load balanced server farm, that exchange information with different nodes of the network 670 for the purpose of receiving, processing and transmitting data to client devices. In this instance, the client computers will typically still be at different nodes of the network 670 than the computers making up servers 650 and 680. Although only a few servers 650, 680 are depicted in FIG. 6, it should be appreciated that a typical system can include a large number of connected servers with each being at a different node of the network 670.

The network 670, and intervening nodes, may include various configurations and protocols including the Internet, World Wide Web, intranets, virtual private networks, wide area networks, local networks, private networks using communication protocols proprietary to one or more companies, Ethernet, WiFi (e.g., 802.11, 802.11b, g, n, or other such standards), and HTTP, and various combinations of the foregoing. Such communication may be facilitated by a device capable of transmitting data to and from other computers, such as modems (e.g., dial-up, cable or fiber optic) and wireless interfaces.

Although certain advantages are obtained when information is transmitted or received as noted above, other aspects of the system and method are not limited to a particular manner of transmission of information. For example, in some aspects, information may be sent via a medium such as a disk, tape or CD ROM. Yet further, although some functions are indicated as taking place on a single server having a single processor, various aspects of the system and method may be implemented by a plurality of servers, for example, communicating information over network 660. In addition to the components described above and illustrated in the figures, various operations will now be described. It should be understood that the following operations do not have to be performed in the precise order described below. Rather, various steps may be handled in a different order or simultaneously. Steps may also be added or omitted unless otherwise stated.

Figure 7:
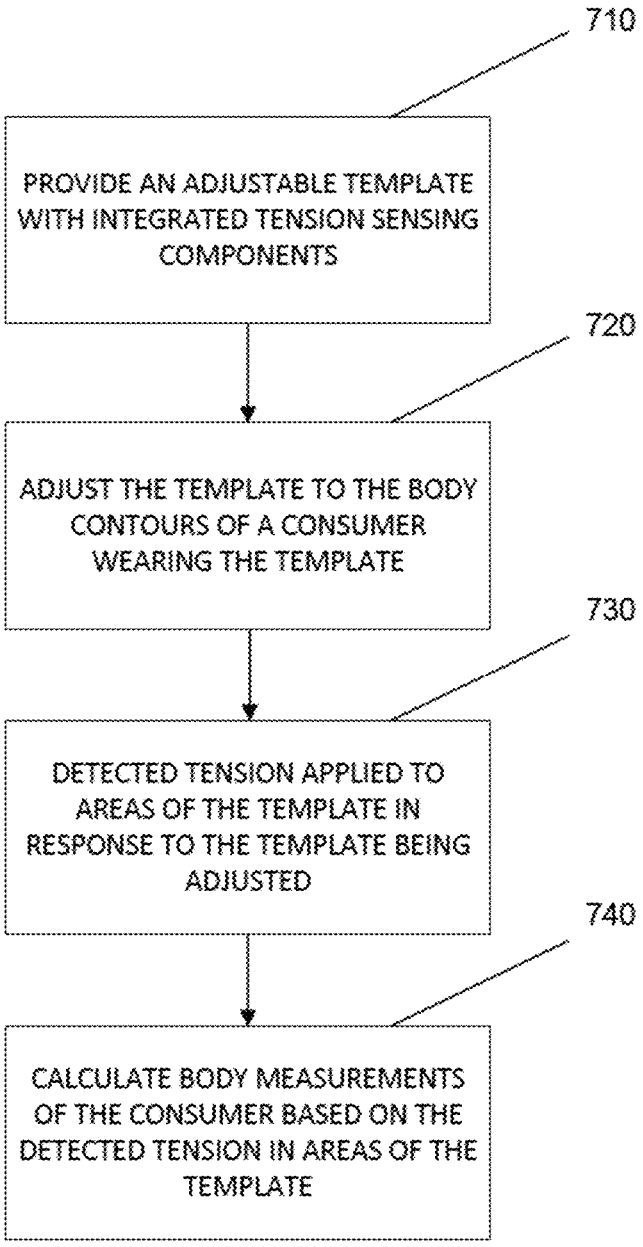
FIG. 7 is a flow diagram for a method in accordance with aspects of the disclosure.

FIG. 7 is a flow diagram for a method 700. The method may be used to determine information regarding the body measurements of a consumer in order to accurately estimate whether a garment that consumer wishes to purchase will fit properly.

In block 710, an adjustable template with integrated tension sensing components may be provided. According to aspects described herein, the template can be constructed from various materials, such as fabric, nylon, latex, a flexible polymer or any type of material that can be fashioned into a wearable item. The template could be in the rough shape of a shirt, a pair of pants, a full body suit or any configuration of garments that can be worn by the consumer, which may also include hats, sleeves, socks, gloves or different types of accessories. In some situations, the template could be in the rough shape of specific items that can be worn by personal in specialized service departments, such as police, military, hazmat, fire, etc. Integrated throughout the template are a number of sensing components that may be adapted to detect the length, width and contours of the consumer. For example, the template may include a plurality of tensile members that can be adjusted to the body measurements of the consumer. In some cases, the template may be embedded with sensors at various locations that can detect tension in the template to determine the contours of the consumer.

In block 720, the template may be adjusted to the body contours of a user wearing the template. For example, the template may be constructed of a flexible material, such as spandex, that can automatically stretch to the shape of a consumer wearing the template. In some situations, the template may be embedded with tensile members that can constrict, expand, or otherwise adapt to the body contours of consumers. In this case, the tensile members can be mechanically adjusted until a desired tension is achieved between the template and the consumer's body.

In block 730, tension applied to areas of the template may be detected in response to the template being adjusted. In this regard, sensors embedded in the template can measure tension in certain areas where the template is stretched to conform to the consumer's shape. Alternatively, tension within a region of the template can be detected based on a displacement of integrated tensile members used to adjust the template to the contours of the consumer.

In block 740, the detected tension may be used to calculate the body measurements of the user. For example, a software algorithm or program executed on a client device or server as described with respect to FIG. 5 may map out an outline the template based on the tension in certain areas of the template. According to aspects, the mapping may consist of a number of (x,y,z) coordinates associated with various positions on the template. The coordinates represent cross sectional measurements made throughout the template. In that regard, the distance between each mapping coordinate can be measured using, for example, inches, millimeters, centimeters, etc. As a result of the mapping, an accurate outline of the consumer may be determined that may be use to accurately estimate a length, width and size of the consumer in order to determine a best "fit" for garments on the consumer.

The above-described aspects of the present disclosure may be advantageous for accurately mass customizing garments for consumers. This technology may be useful to "Brick and Mortar" retail stores, online apparel shopping sites, clothing designers and for mass producing specialized clothing, such as uniforms for service departments where fit is tied to job performance, or compression garments for athletes where an ideal amount and location of compression can be computed for a specific sport the athlete competes in. By using a adjustable template that can sense and adapt to the body measurements of consumers, the template can effectively measure the consumer's length, width, depth and size to determine a best "fit" for apparel on the consumer. Moreover, the various techniques and parameters disclosed within may be further reconfigured to customize garments effectively and with greater precision to avoid time wasted through back and forth communication with the consumers and reduce the risk of consumer rejections.

As these and other variations and combinations of the features discussed above can be utilized without departing from the disclosure as defined by the claims, the foregoing description of the embodiments should be taken by way of illustration rather than by way of limitation of the disclosure as defined by the claims. It will also be understood that the provision of examples of the disclosure (as well as clauses phrased as "such as," "e.g.", "including" and the like) should not be interpreted as limiting the disclosure to the specific examples; rather, the examples are intended to illustrate only some of many possible embodiments.

The invention claimed is:

1. A system, comprising:

a template adapted to be worn by a user, the template comprising a plurality of sensors configured to detect an amount of excess pressure exerted in a given area of the template and to indicate a distance from the given area of the template to the skin of the user so as to obtain body measurement information of the user; and a computing device in communication with the plurality of sensors, the computing device configured to determine a set of dimensions of at least one portion of the user based on the body measurement information and configured to map a number of coordinates to the given area based on the amount of excess pressure exerted in the given area and the distance between the given area of the template and the skin of a user, wherein the set of dimensions correspond to a length, width, depth and size of the at least one portion of the user, the depth being the distance from the given area of the template to the skin of the user.

2. The system of claim 1, wherein the template further comprises an elastic material that can adjust to body contours of the user.

3. The system of claim 1, wherein the computing device is further configured to generate an outline of the user based on the mapping coordinates, the outline corresponding to the body measurements of the user.

4. The system of claim 1, wherein a field of sensitivity of a first sensor of the plurality of sensors overlaps with a field of sensitivity of a second sensor of the plurality of sensors, and cross readings from the first and second of the plurality of sensors are mapped to provide one coordinate of the number of coordinates.

5. A system, comprising:

a template adapted to be worn by a user, the template comprising a plurality of tensile members configured to obtain body measurement information of the user and a sensing platform configured to indicate a distance between from the given area of the template to the skin of the user; and a computing device in communication with the template, the computing device configured to determine a set of dimensions of at least one portion of the user based on the body measurement information and configured to map a number of coordinates to a given area of the template based on a longitudinal position and a latitudinal positions of the tensile members and the distance between the given area of the template and the skin of a user, wherein the set of dimensions correspond to a length, width, depth and size of the at least one portion of the user, the distance being the depth.

6. The system of claim 5, wherein the tensile members comprise a flexible material.

7. The system of claim 6, further comprising an input device coupled to the template, the input device being configured to receive size measurements for the template.

8. The system of claim 7, wherein the tensile members are adjusted in response to the inputted size measurements, so as to conform the template to body contours of the user.

9. The system of claim 5, wherein tensile members are adjustable in a longitude and lateral direction.

10. The system of claim 5, wherein the computing device is further configured to calculate cross sectional measurements of the template based on the mapping coordinates, the cross sectional measurements corresponding to the body measurements of the user.

11. The system of claim 5, wherein the sensing platform is configured to automatically contract or expand the plurality of tensile members so as to adjust the template to the body measurement information of the user.

12. A system, comprising:

a template adapted to be worn by a user, the template including a sensing layer configured to detect an amount of excess pressure exerted in a given area of the template and to indicate a distance from the given area of the template to the skin of the user so as to obtain body measurement information of the user;

a client device coupled to the template, the client device configured to receive the body measurement information from the template and to determine size measurements for the template; and a server in communication with the client device, the server configured to receive the size measurements from the client device and configured to map a number of coordinates to the given area based on the amount of excess pressure exerted in the given area and the distance between the given area of the template and the skin of a user so as to calculate a custom fit of a garment for the user based on the size measurements.

13. The system of claim 12, wherein the sensing layer comprises a plurality of sensors.

14. The system of claim 12, wherein the sensing layer comprises a plurality of tensile members.

15. The system of claim 14, wherein the tensile members are adjustable in a longitude and lateral direction.

16. The system of claim 12, wherein the size measurements are based on the body measurement information obtained from the template.

17. The system of claim 12, wherein the size measurements are based on size input parameters obtained from an input device, the input device is attached to the client device.

18. The system of claim 17, wherein the tensile members are adjusted in response to the size input parameters.

* * * * *